US008910407B2

(12) United States Patent
Singh

(10) Patent No.: US 8,910,407 B2
(45) Date of Patent: Dec. 16, 2014

(54) HANDGUN ARM HANDLE

(71) Applicant: Rajpreet Singh, Bellevue, WA (US)

(72) Inventor: Rajpreet Singh, Bellevue, WA (US)

( * ) Notice: Subject to any disclaimer, the term of this patent is extended or adjusted under 35 U.S.C. 154(b) by 0 days.

(21) Appl. No.: 13/957,286

(22) Filed: Aug. 1, 2013

(65) Prior Publication Data

US 2014/0053447 A1 Feb. 27, 2014

Related U.S. Application Data

(60) Provisional application No. 61/692,594, filed on Aug. 23, 2012.

(51) Int. Cl.
*F41C 23/12* (2006.01)
*F41C 23/06* (2006.01)

(52) U.S. Cl.
CPC ..... *F41C 23/06* (2013.01); *F41C 23/12* (2013.01)
USPC ..... 42/71.02; 42/85; 42/94; 89/37.04

(58) Field of Classification Search
USPC ..... 42/72, 73, 71.02, 85, 90, 94, 106; 89/37.04
See application file for complete search history.

(56) References Cited

U.S. PATENT DOCUMENTS 3,162,966 A * 12/1964 La Coss ..... 42/72
3,184,877 A * 5/1965 Andrews ..... 42/72
3,609,902 A 10/1971 Casull
3,648,396 A * 3/1972 Smith ..... 42/94
4,271,623 A * 6/1981 Beretta ..... 42/72
4,291,482 A * 9/1981 Bresan ..... 42/72
5,018,294 A 5/1991 McGuffee
5,180,874 A 1/1993 Troncoso, Jr.
5,228,610 A 7/1993 Spence
5,445,479 A * 8/1995 Hillinger ..... 408/16
5,761,842 A * 6/1998 Mantymaa ..... 42/71.02
5,778,588 A * 7/1998 Allen et al. ..... 42/71.02
6,016,620 A 1/2000 Morgan
6,070,809 A * 6/2000 Price ..... 239/273
6,324,728 B1 * 12/2001 Blankenheim ..... 16/431
6,678,986 B2 1/2004 Roush
6,829,856 B1 12/2004 Moorman
7,637,882 B2 * 12/2009 Carman et al. ..... 602/21
8,091,264 B2 1/2012 Goertz

* cited by examiner

*Primary Examiner* — Benjamin P Lee
(74) *Attorney, Agent, or Firm* — Christensen O'Connor Johnson Kindess PLLC

(57) ABSTRACT

A handgun forearm support suitable, for example, for target and competitive handgun shooting, includes a grip adaptor configured to engage the grip of a handgun, an intermediate joint member that attaches to a proximal end of the grip adaptor with a pivot assembly, and a forearm brace that rotatably and lockably engages a proximal end of the intermediate joint member. Preferably the locking engagement is hand-operable, for example a joint having mating parts with interlocking radial teeth, with a wing nut and bolt engagement. The grip adaptor may insert into a recess in the handgun grip, or engage the sides of the handgun grip. One or more removably locking pins or screws lock the handgun to the grip adaptor.

16 Claims, 7 Drawing Sheets

HANDGUN ARM HANDLE

CROSS-REFERENCE TO RELATED APPLICATION

This application claims the benefit of U.S. Provisional Patent Application No. 61/692,594, filed Aug. 23, 2012, the disclosure of which is hereby expressly incorporated by reference in its entirety.

BACKGROUND

Small firearms, handguns, pistols, and the like, can generate considerable recoil forces. In some shooting competitions handguns are held in one hand when firing, and in some competitions the shooter's non-firing hand may be used to brace the firing hand. Typically, the wrist of the firing hand is tightly gripped by the support hand. This helps to steady the gun and improve the shooter's score.

Various devices have been developed to steady the hand of the shooter, to improve performance, and overcome the effects of the recoil. For example, broad wrist bands with reinforcing rods may be tightly applied to the shooting wrist to help keep the wrist in a fixed position. Such straps may help to steady the shooter's aim, thereby improve scoring, and may prevent a collapsing wrist, absorbing and deflecting the gun recoil.

Frequently, pistol competitions use single shot handguns. With a single shot high powered pistol, for example, it is especially desirable to make each shot count with the greatest accuracy. While the wrist wrap has some benefit, it would be desirable to be able to provide a simple and efficient means of further improving handgun shooting accuracy.

Muzzle rise is a common phenomenon in all widely used firearms. Muzzle rise reduces accuracy of the firearms and makes it difficult to engage a target for a subsequent round. As the power of the cartridge increases, recoil forces and muzzle rise increase proportionately. Because of the absence of a shoulder stock, all of the recoil forces are transferred by the shooter's hand muscles to the body of the shooter. The barrel axis lies above the center axis of the arm, so a twisting moment occurs at the wrist of the shooter. The wrist muscles of the shooter may not be able to absorb all of the impact recoil forces, so the forward end of the firearm rises upward, resulting in muzzle rise.

A device for transferring recoil forces to the forearm of the shooter is disclosed. The proximal end of the device, the forearm brace, directly engages the forearm of the shooter. When the cartridge is fired, the proximal end of the forearm support is urged downwardly. This movement is reacted by the shooter's arm, so the handgun remains more stable, improving shooter accuracy.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A forearm support includes a forearm brace with a U-shaped proximal portion and a distally-extending arm portion. The arm portion is attached to an intermediate joint member, such that the angular orientation between the arm portion and the intermediate joint member may be adjusted and locked into a desired position. In one embodiment, a compressible pad is fixed to the U-shaped proximal portion. A grip adaptor is connected to the intermediate joint member with a pivot assembly. The grip adaptor includes a distal portion that engages the handgun.

In an exemplary embodiment, the grip adaptor includes a proximal portion with an aperture that engages the intermediate joint member, and a distal arm that extends at an angle to the proximal arm and is configured to be inserted into a corresponding recess in the grip of the handgun. Optionally, a locking pin may be provided that extends through an aperture in the distal arm, and into an aperture in the grip to lock the handgun to the grip adaptor.

In another exemplary embodiment, the grip adaptor includes a proximal arm that pivotally engages the intermediate joint member, and a distal pair of spaced apart plates that are configured to be releasably attached to the handgun. For example, the grip is positioned between the spaced apart plates and a locking pin is inserted through aligned apertures in the plates, and through a corresponding aperture in the grip.

In an embodiment, the distal end of the arm portion of the forearm brace includes a first aperture and a plurality of teeth extending radially from the aperture, and the proximal end of the intermediate joint member comprises a second aperture and a plurality of teeth extending radially from the aperture and configured to engage the forearm brace plurality of teeth, and the lockable rotatable joint assembly is a bolt that extends through the first and second aperture, and a wing nut that engages the bolt.

In an embodiment, the distally extending arm portion of the forearm brace is disposed at an angle, such that the U-shaped portion is aligned with the intermediate joint member.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
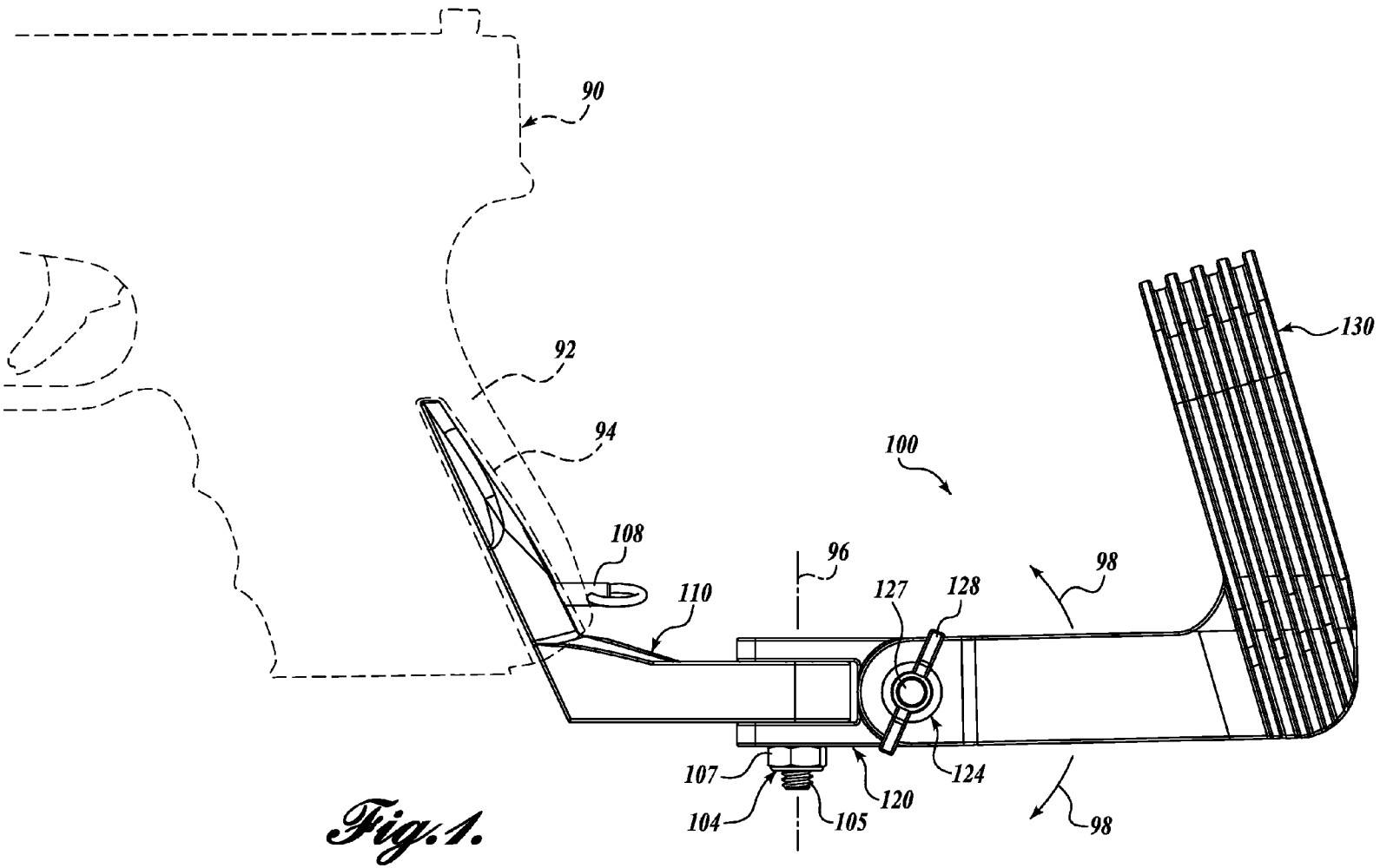
FIG. 1 is a side view of a handgun forearm support in accordance with the present invention, with a handgun indicated in phantom.
Figure 2:
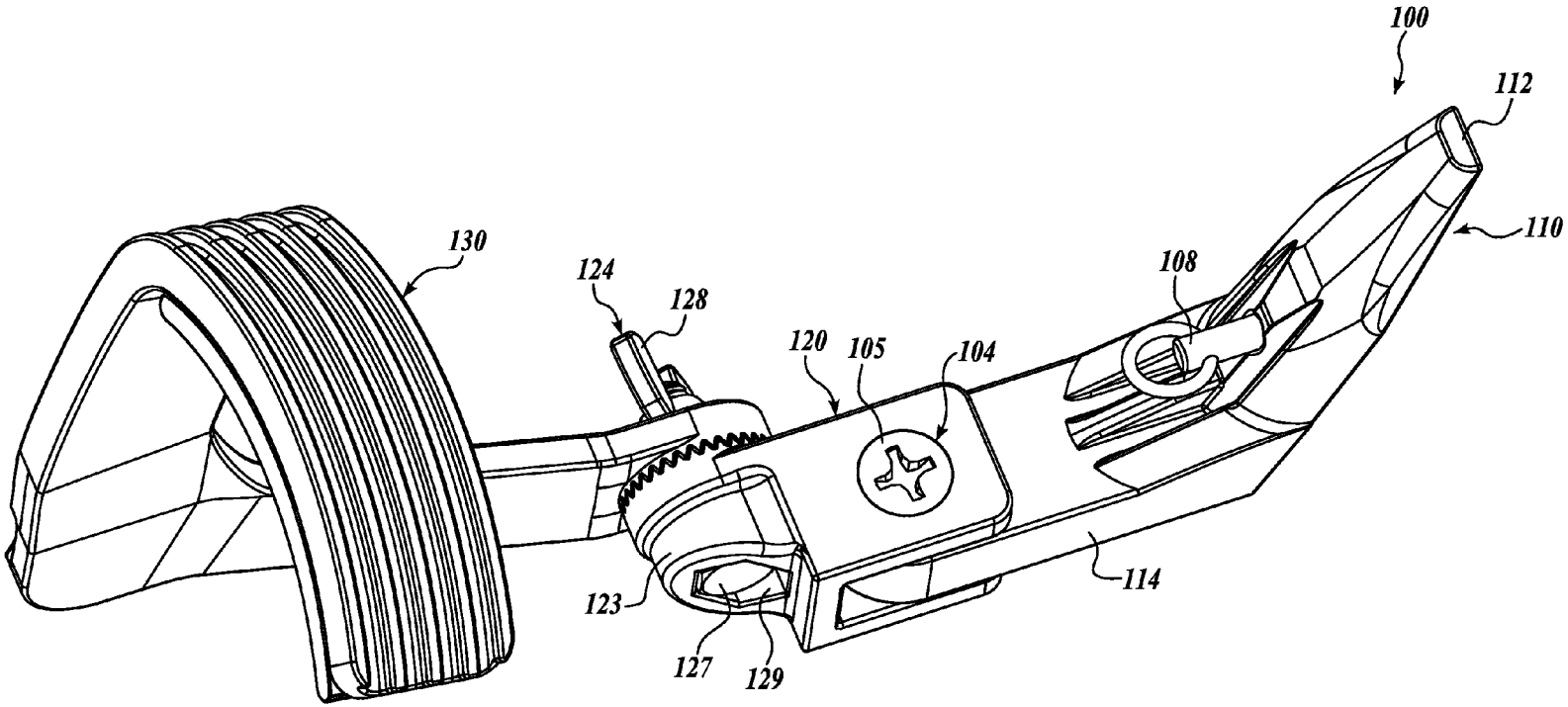
FIG. 2 is an upper perspective view of the handgun forearm support shown in FIG. 1.

Particular embodiments of a handgun forearm support will now be described with reference to the FIGURES, wherein like numbers indicate like parts. A side view of a handgun forearm support 100 in accordance with the present invention is shown in FIG. 1, with a handgun 90 shown in phantom. A perspective view of the handgun forearm support 100 is shown in FIG. 2. The handgun forearm support 100 includes a handgun grip adaptor 110, an intermediate joint member 120 that attaches to the grip adaptor 110 with a pivot assembly 104, and a forearm brace 130 that lockably and pivotably attaches to the intermediate joint member 120 with a bolt assembly 124.

In this embodiment, the grip adaptor 110 is configured to be inserted into a recess 94 in a grip 92 of the handgun 90 (shown in phantom in FIG. 1). Optionally, a locking pin 108 may lock the grip adaptor 110 to the handgun grip. The pivot assembly 104 allows the grip adaptor 110 to pivot about the axis 96 during use. The angular orientation of the grip adaptor 110 with respect to the forearm brace 130 may be adjusted, as indicated by arrow 98, and the desired position may then be locked in place with the bolt assembly 124.

Figure 3:
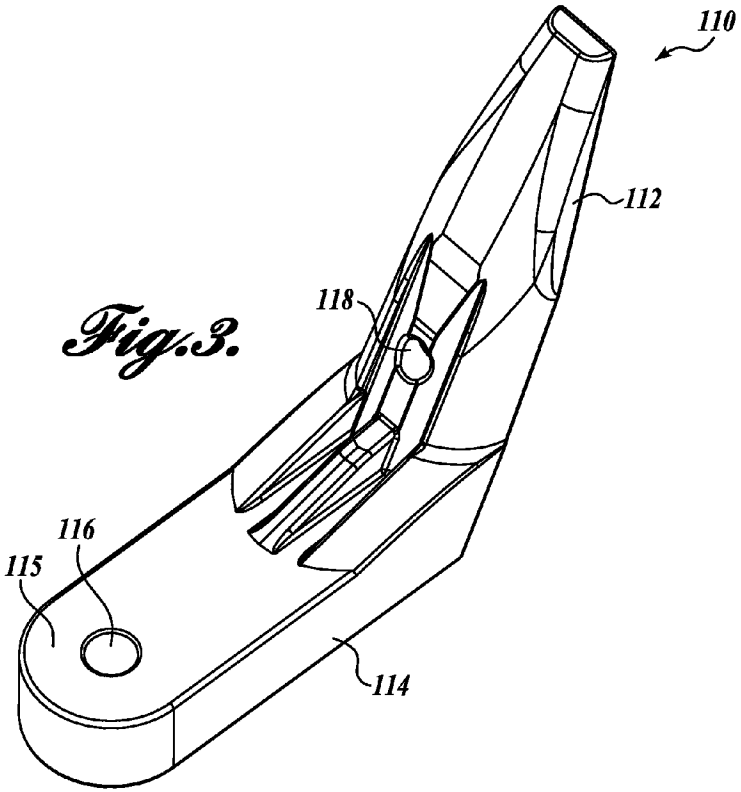
FIG. 3 is a perspective view of the grip adaptor for the forearm support shown in FIG. 1.

The grip adaptor 110 is shown in isolation in FIG. 3. The grip adaptor 110 is generally L-shaped, with a tapered distal arm 112 configured to be inserted into the corresponding recess 94 in a handgun grip 92, and a proximal arm 114 that engages the intermediate joint member 120. The distal arm 112 is disposed at an angle relative to a proximal arm 114. In a current embodiment, the angle between the distal arm 112 and the proximal arm 114 is greater than 90 degrees, and may be, for example, an angle between 90 degrees and 135 degrees. The distal arm 112 optionally includes a locking pin aperture 118 that is sized to slidably receive the locking pin 108 for securing the handgun 90 to the grip adaptor 110. For example, a corresponding aperture (not shown) may be provided in the grip 92.

The free end 115 of the proximal arm 114 is sized and shaped to be inserted between a pair of prongs 121, 122 on the intermediate joint member 120 (FIG. 4), and includes an aperture 116 configured to receive the pivot assembly 104.

Figure 4:
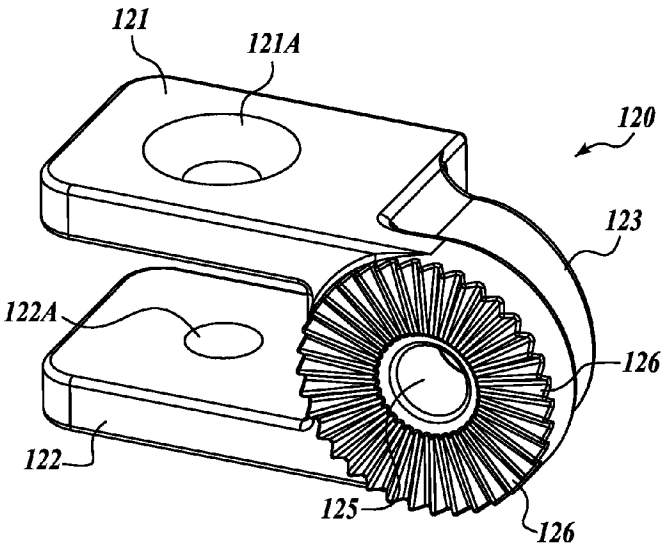
FIG. 4 is a perspective view of the intermediate joint member for the forearm support shown in FIG. 1.

A perspective view of the intermediate joint member 120 is shown in isolation in FIG. 4. The pair of prongs 121, 122 define aligned apertures 121A, 122A, respectively, that are sized and configured to receive the pivot assembly 104. The prongs 121, 122, free end 115 of the grip adaptor 110, and pivot assembly 104 (FIG. 1), therefore, cooperatively form a clevis-type joint or clevis fastener. In this embodiment, the pivot assembly 104 comprises a bolt 105 that extends through the apertures 121A, 116, 121B, and a nut 107 that engages the threaded portion of the bolt 105.

The intermediate joint member 120 further includes a head portion 123 extending proximally from the prongs 121, 122. The head portion 123 defines a center aperture 125 and a plurality of teeth 126 that extend radially from the center aperture 125.

Figure 5:
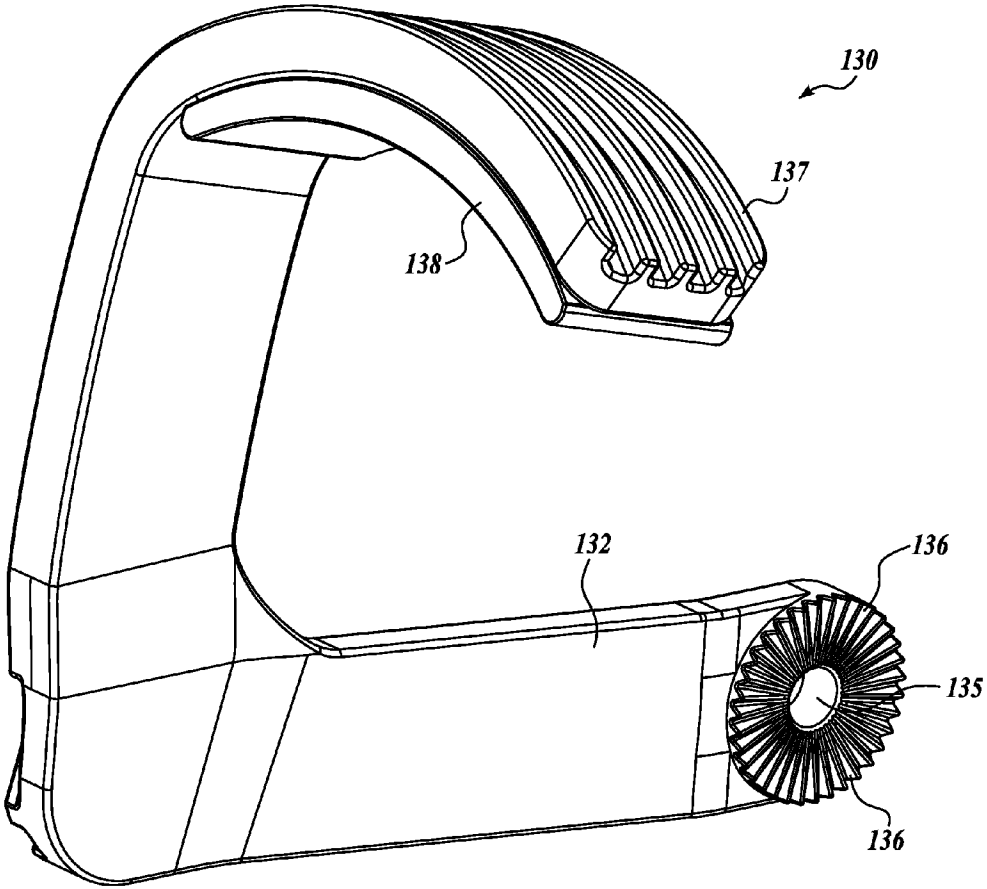
FIG. 5 is a perspective view of the forearm brace for the forearm support shown in FIG. 1.

A perspective view of the forearm brace 130 is shown in FIG. 5. The forearm brace 130 includes a distally extending arm 132 having an aperture 135 with a plurality of radially-extending teeth 136 that are sized to engage the radial teeth 126 on the head portion 123 of the intermediate joint member 120. A U-shaped proximal portion 137 is configured to engage the shooter's forearm during use. Optionally, a flexible, compressible pad 138 is affixed to the U-shaped proximal portion 137. For example, the pad 138 may be formed from a natural or synthetic rubber, ethylene vinyl acetate (EVA), or a polymeric foam material.

The bolt assembly 124 includes a bolt 127 and a wing nut 128. The bolt 127 extends through the apertures 125, 135. A shaped recess 129 (FIG. 2) in the head portion 123 of the intermediate joint member 120 receives the head of the bolt 127 to prevent rotation. The radial teeth 136 on the forearm brace 130 are positioned to engage the radial teeth 126 on the joint member 120, such that a desired angle between the forearm brace 130 and the grip adaptor 110 is established, and the wing nut 128 is then finger-tightened to lock the forearm brace 130 to the joint member 120 at the desired angle.

Figure 6:
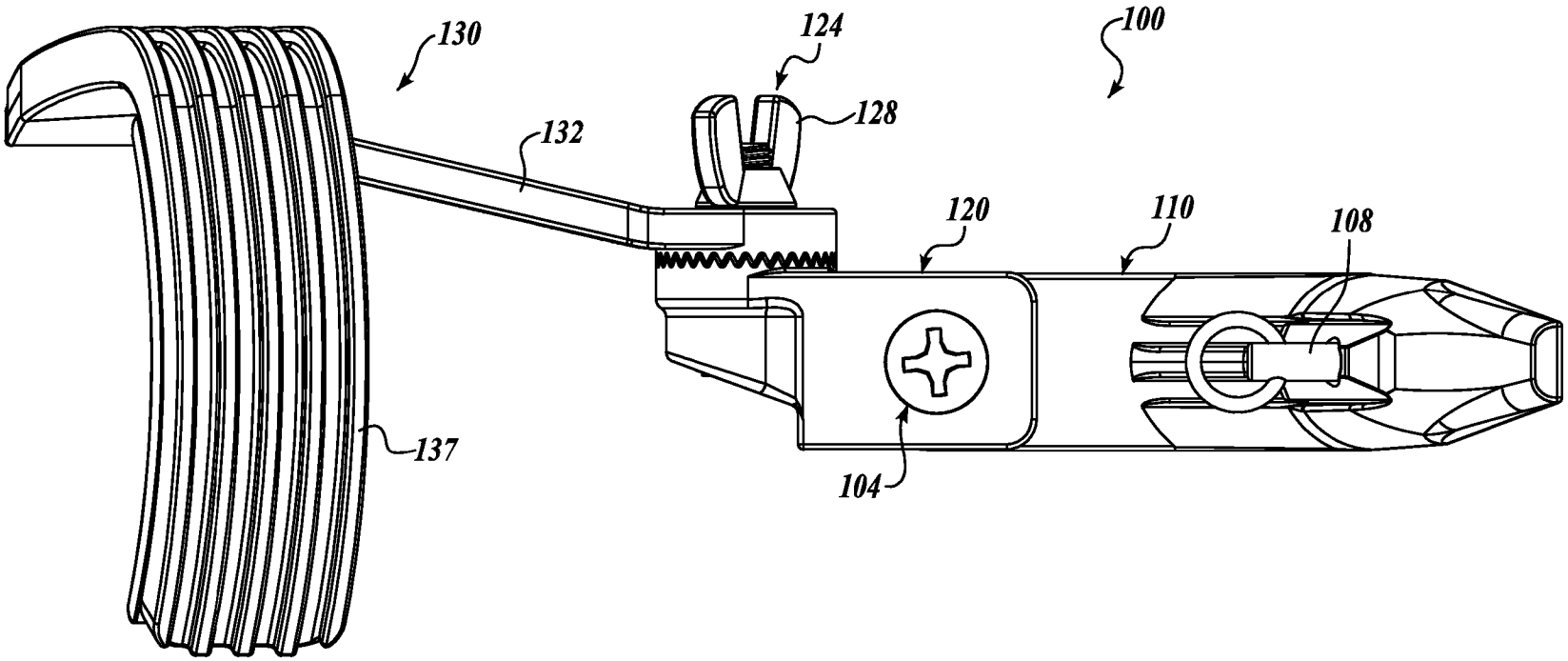
FIG. 6 is a plan view of the handgun forearm support shown in FIG. 1.

A plan view of the assembled handgun forearm support 100 is shown in FIG. 6. It will be appreciated that the distally extending arm 132 of the forearm brace 130 is disposed at an angle, such that the center of the U-shaped proximal portion 137 is approximately aligned with the intermediate joint member 120. Therefore, the hand of the shooter gripping the handgun 90 will be properly aligned with the handgun 90.

The grip adaptor 110, intermediate joint member 120, and forearm brace 130 may be formed from any suitable material. For example, in a current embodiment these components are made primarily of an impact absorbing, high-strength polymer.

Figure 7:
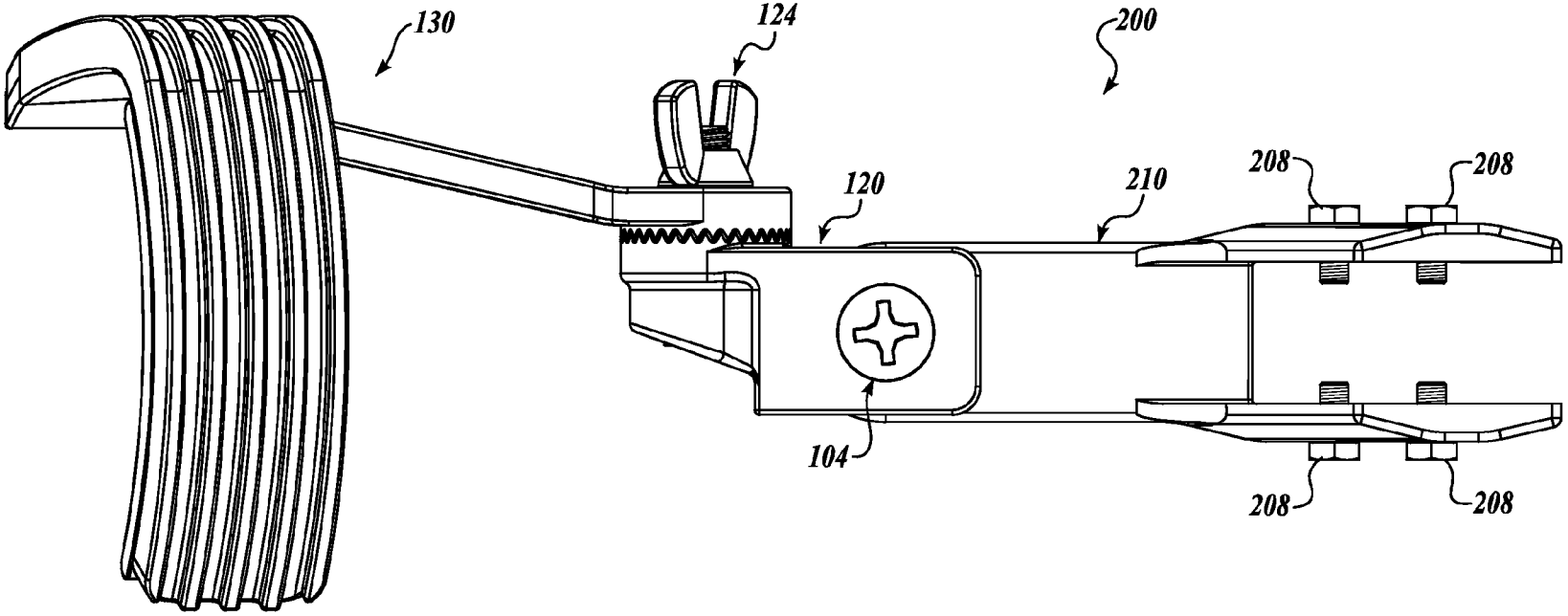
FIG. 7 is a plan view of a second embodiment of a handgun support assembly in accordance with the present invention.
Figure 8:
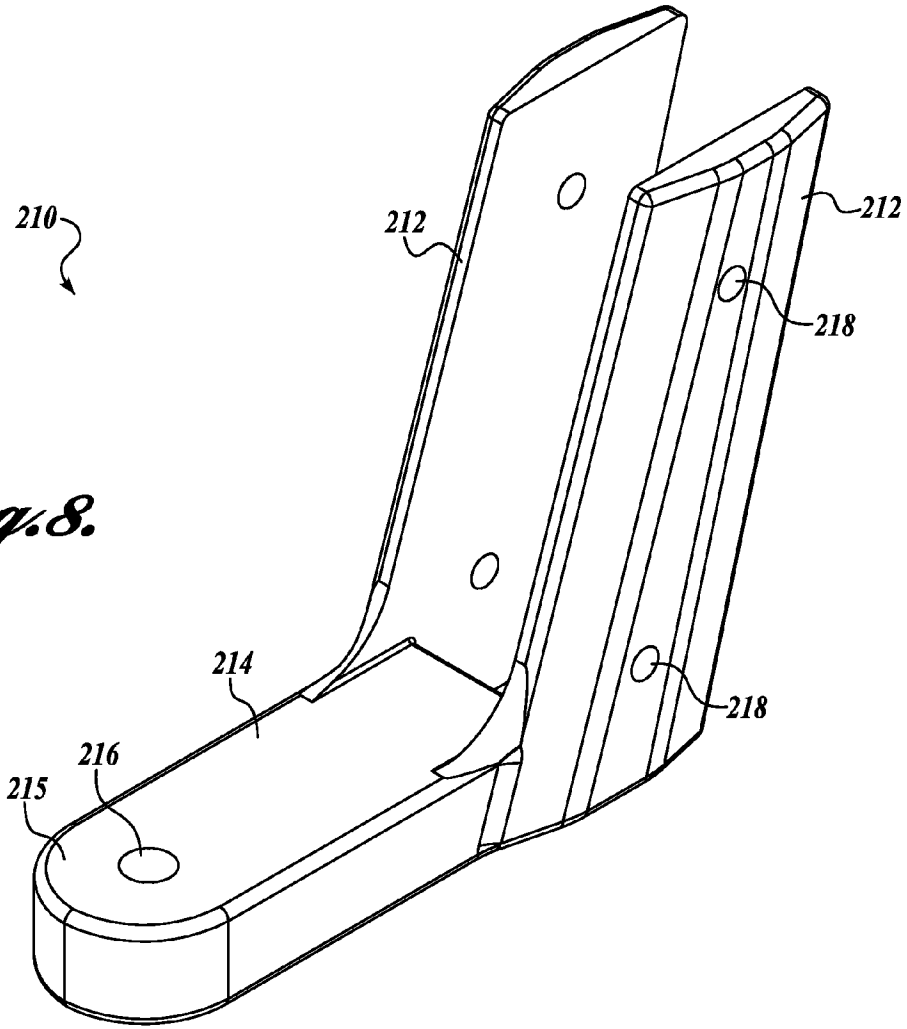
FIG. 8 is a perspective view of the grip adaptor for the handgun support assembly shown in FIG. 7.

A plan view of another embodiment of a handgun forearm support 200, in accordance with the present invention, is shown in FIG. 7. In this embodiment, the intermediate joint member 120, forearm brace 130, pivot assembly 104, and bolt assembly 124 are similar to the corresponding components described above. A grip adaptor 210 is pivotably attached to the joint member 120 with the pivot assembly 104. Refer also to FIG. 8, which shows the grip adaptor 210 in isolation.

The grip adaptor 210 includes a proximal arm 214 with a free end 215 having an aperture 216 that is configured to receive the bolt 105 of the pivot assembly 104, similar to the grip adaptor 110 shown in FIG. 3, and described above. In this embodiment, a pair of parallel, spaced apart plates 212 are formed integrally with the proximal arm 114, and extend distally therefrom. The plates 212 are sized and spaced apart to receive the handgun grip 92 (FIG. 1). The plates 212 include one or more apertures 218 (two shown in each plate 212) that are configured to receive threaded screws 208. In this embodiment, the handgun grip 92 may be configured with a pair of transverse apertures (not shown) that are positioned and configured to also engage the threaded screws 208. To attach the forearm support 200 to the handgun 90 the shooter positions the grip 92 in the space between the plates 212, and attaches the threaded screws 208 through the apertures 218 and through corresponding threaded apertures (not shown) in the grip 92.

To use either of the forearm supports 100, 200, the shooter attaches the handgun 90 to the grip adaptor 110 or 210, and inserts the corresponding pin(s) 108 or screws 208. The shooter may then hold the grip 92, such that the forearm brace 130 overlies the shooter's forearm. The wing nut 128 is then loosened to set the angular orientation between the forearm brace 130 and the handgun 90 at a desired setting, and the wing nut 128 is tightened. The shooter may then pivot about grip adaptor 110, 210 to the desired position and take aim.

While illustrative embodiments have been illustrated and described, it will be appreciated that various changes can be made therein without departing from the spirit and scope of the invention.

The invention claimed is:

1. A forearm support for supporting a handgun, the forearm support comprising:

a grip adaptor configured to engage the grip of the handgun;

a forearm brace comprising a U-shaped proximal portion and an arm portion extending distally from the proximal portion; and an intermediate joint member comprising (i) a lockable rotatable joint assembly that is operable to releasably lock the intermediate joint member to the forearm brace at a selectable angular orientation about a first axis, and (ii) a pivot joint assembly that is operable to pivotably connect the intermediate joint member to the grip adaptor, such that the grip adaptor is pivotable about a second axis that is generally perpendicular to the first axis, wherein the first axis and the second axis are disposed between the grip of the handgun and the U-shaped proximal portion of the forearm brace;

wherein the forearm brace is configured to permit a user to pivot the handgun about the second axis while transmitting a recoil force from the handgun to the user's forearm.

2. The forearm support of claim 1, wherein the grip adaptor comprises a proximal arm that pivotably engages the intermediate joint member, and a distal portion that is configured to releasably attach to a grip of the handgun.

3. The forearm support of claim 2, wherein the grip adaptor distal portion comprises a tapered arm that is configured to be slidably inserted into a recess in the grip of the handgun.

4. The forearm support of claim 3, wherein the tapered arm defines an aperture, and further comprising a releasable pin that is configured to extend through the tapered arm aperture to lock the tapered arm to the grip of the handgun.

5. The forearm support of claim 1, wherein the grip adaptor comprises a proximal arm that pivotally engages the intermediate joint member, and a distal portion comprising a pair of spaced apart plates configured to be releasably attached to the handgun.

6. The forearm support of claim 5, further comprising at least one attachment screw, and wherein the spaced apart plates comprise at least one aperture that is configured to receive the at least one attachment screw.

7. The forearm support of claim 1, further comprising a flexible, compressible pad that is affixed to the U-shaped proximal portion of the forearm brace.

8. The forearm support of claim 1, wherein a distal end of the arm portion of the forearm brace comprises a first aperture and a plurality of teeth extending radially from the aperture, and the proximal end of the intermediate joint member comprises a second aperture and a plurality of teeth extending radially from the aperture and configured to engage the forearm brace plurality of teeth, and further wherein the lockable rotatable joint assembly comprises a bolt that extends through the first and second aperture, and a wing nut that engages the bolt.

9. The forearm support of claim 1, wherein the distally extending arm portion of the forearm brace is disposed at an angle, such that the U-shaped portion is aligned with the intermediate joint member.

10. A handgun accessory comprising:

a forearm brace having an arcuate portion configured to overlie a user's forearm during use, and an elongate arm portion extending from the arcuate portion, the elongate arm having a first locking member;

an intermediate joint assembly having a second locking member that engages the first locking member such that the forearm brace can be pivoted about a first axis and locked to the intermediate joint assembly at a selectable angle of engagement, the intermediate joint assembly further having a pivot member; and a grip adaptor having a first arm with an aperture configured to engage the pivot member, such that the grip adaptor is pivotable with respect to the intermediate joint assembly about a second axis that is generally perpendicular to the first axis, and a handgun engagement portion configured to engage a handgun grip;

wherein the first axis and the second axis are disposed between the handgun engagement portion of the grip adaptor and the arcuate portion of the forearm brace, and wherein the handgun accessory is configured to permit a user to pivot the handgun about the second axis while transmitting a recoil force from the handgun to the user's forearm.

11. The handgun accessory of claim 10, wherein the grip adaptor handgun engagement portion is configured to releasably attach to the handgun grip.

12. The handgun accessory of claim 11, wherein the engagement portion comprises a tapered arm that is configured to be slidably inserted into a recess in the handgun grip.

13. The handgun accessory of claim 12, wherein the tapered arm defines an aperture, and further comprising a releasable pin that is configured to extend through the tapered arm aperture to lock the tapered arm to the handgun grip.

14. The handgun accessory of claim 10, wherein the grip adaptor handgun engagement portion comprises a pair of spaced apart plates configured to be releasably attached to the handgun grip.

15. The handgun accessory of claim 14, further comprising at least one screw, and wherein the spaced apart plates comprise at least one aperture that is configured to receive the at least one screw.

16. The handgun accessory of claim 10, further comprising a rubber pad that is affixed to the arcuate portion of the forearm brace.

* * * * *